US006212764B1

(12) United States Patent
Schornhorst et al.

(10) Patent No.: US 6,212,764 B1
(45) **Date of Patent: *Apr. 10, 2001**

(54) LINK BENDING MACHINE

(75) Inventors: Carl Eckardt Schornhorst, Canton, MI (US); Gerald Joseph Selm; Kevin Bennett Wise, both of Connersville, IN (US)

(73) Assignee: Visteon Global Technologies, Inc., Dearborn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/992,325

(22) Filed: Dec. 17, 1997

(51) Int. Cl.[7] ..... B23P 15/26

(52) U.S. Cl. ..... 29/727; 29/890.03; 29/708

(58) Field of Search ..... 29/727, 720, 822, 29/708, 890.03, 890.039; 72/316, 214, 220, 381, 384, 379.2

(56) References Cited

U.S. PATENT DOCUMENTS

| | | | | |
|---|---|---|---|---|
| 3,207,216 | | 9/1965 | Donaldson . | |
| 3,425,113 | | 2/1969 | Ward, Jr. . | |
| 3,466,914 | * | 9/1969 | Gilchrist | 72/214 |
| 3,734,171 | | 5/1973 | Ares et al. . | |
| 3,762,031 | | 10/1973 | Jonason et al. . | |
| 3,802,246 | * | 4/1974 | Goff | 72/381 |
| 4,274,482 | | 6/1981 | Sonoda . | |
| 4,350,201 | | 9/1982 | Steineman . | |
| 4,434,643 | | 3/1984 | Almqvist et al. . | |
| 4,562,630 | | 1/1986 | Larsson . | |
| 4,679,410 | | 7/1987 | Drayer . | |
| 4,944,176 | * | 7/1990 | Glorieux et al. | 72/319 |
| 5,125,453 | | 6/1992 | Bertrand et al. . | |
| 5,176,017 | * | 1/1993 | Tokai | 72/316 |
| 5,507,338 | | 4/1996 | Schornhorst et al. . | |
| 5,732,460 | * | 3/1998 | Paternoster et al. | 29/727 |
| 5,937,935 | * | 8/1999 | Schornhorst et al. | 72/379.2 |

FOREIGN PATENT DOCUMENTS

| | | |
|---|---|---|
| 61-217697 | 9/1986 | (JP) . |
| 62-203632 | 9/1987 | (JP) . |
| 63-187097 | 8/1988 | (JP) . |
| 63-278621 | 11/1988 | (JP) . |

* cited by examiner

*Primary Examiner*—S. Thomas Hughes
*Assistant Examiner*—Jermie E. Cozart
(74) *Attorney, Agent, or Firm*—Brinks Hofer Gilson & Lione

(57) ABSTRACT

A machine for bending a first set and a second set of folded deformable links projecting outwardly from a heat exchanger core made is disclosed. The machine comprises a base, a transport mechanism for transporting the core to a workstation, a locking mechanism for locking the core in a predetermined orientation in the workstation, and a bending mechanism attached to the base for bending a set of folded deformable links against the core.

3 Claims, 7 Drawing Sheets

LINK BENDING MACHINE

BACKGROUND OF THE INVENTION

1. Field of the Invention

The present invention relates generally to machines for fabricating heat exchangers. More particularly, the present invention relates to a machine for bending links projecting from heat exchangers.

2. Disclosure Information

Plate-fin heat exchangers are well known in the art. In these types of heat exchangers, a plurality of elongated plates are joined together, such as through a lamination process to define a plurality of passageways for the movement of a fluid therethrough. Each of the passageways is formed by the inwardly facing surfaces of a pair of joined plates. The interior surfaces of the joined plates generally define a central fluid conducting section. The passageways are interconnected so that a fluid may flow through the plurality of joined plates forming the heat exchanger. As is also known in the art, conductive fin strips are located between outwardly facing surfaces of the pairs of joined plates. Heat exchangers of this type have particular utility as evaporators for air conditioning systems of motor vehicles.

It is known to manufacture these types of heat exchangers from a plurality of interconnected plate members, stamped from a sheet of deformable material. U.S. Pat. No. 5,507,338, assigned to the assignee of the present invention, the disclosure of which is hereby incorporated by reference, teaches one such method of folding a plurality of plate members in a zig-zag or bellows-like fashion to fabricate a heat exchanger core. A plurality of links interconnect the plate members. Upon folding, these links project from the heat exchanger core, making it difficult to stack cores one upon another without damaging an adjacent core. It would therefore be desirable to minimize the links and the amount the links project from the folded core.

It is an object of the present invention to provide a machine which can bend the tab members extending from the core against the core to minimize the damage to the heat exchanger and to surround components.

SUMMARY OF THE INVENTION

The present invention overcomes the problems associated with the prior art by providing a machine for bending a first set and a second set of folded deformable links projecting outwardly from a heat exchanger core made from a continuous strip of preformed, generally planar plates interconnected together in a bellows-like manner by the first and second set of folded deformable links. The machine comprises a base, a transport mechanism for transporting the core to a workstation, a locking mechanism for locking the core in a predetermined orientation in the workstation, and a bending mechanism attached to the base for bending the first set of folded deformable links against the core in a direction generally perpendicular to the plane of the plates and for bending the second set of folded deformable links in a direction generally parallel to the plane of the plates. In one embodiment, the bending mechanism for bending the first set of deformable links against the core further includes a reciprocating die which applies a force against the first set of deformable links in a direction perpendicular to the plane of the plates.

It is an advantage of the present invention to provide a machine which minimizes the amount tab members project from the heat exchanger by bending the links against the core. These and other objects, features and advantages of the present invention will become apparent from the drawings, detailed description and claims which follow.

DETAILED DESCRIPTION OF THE PREFERRED EMBODIMENTS

Figure 1:
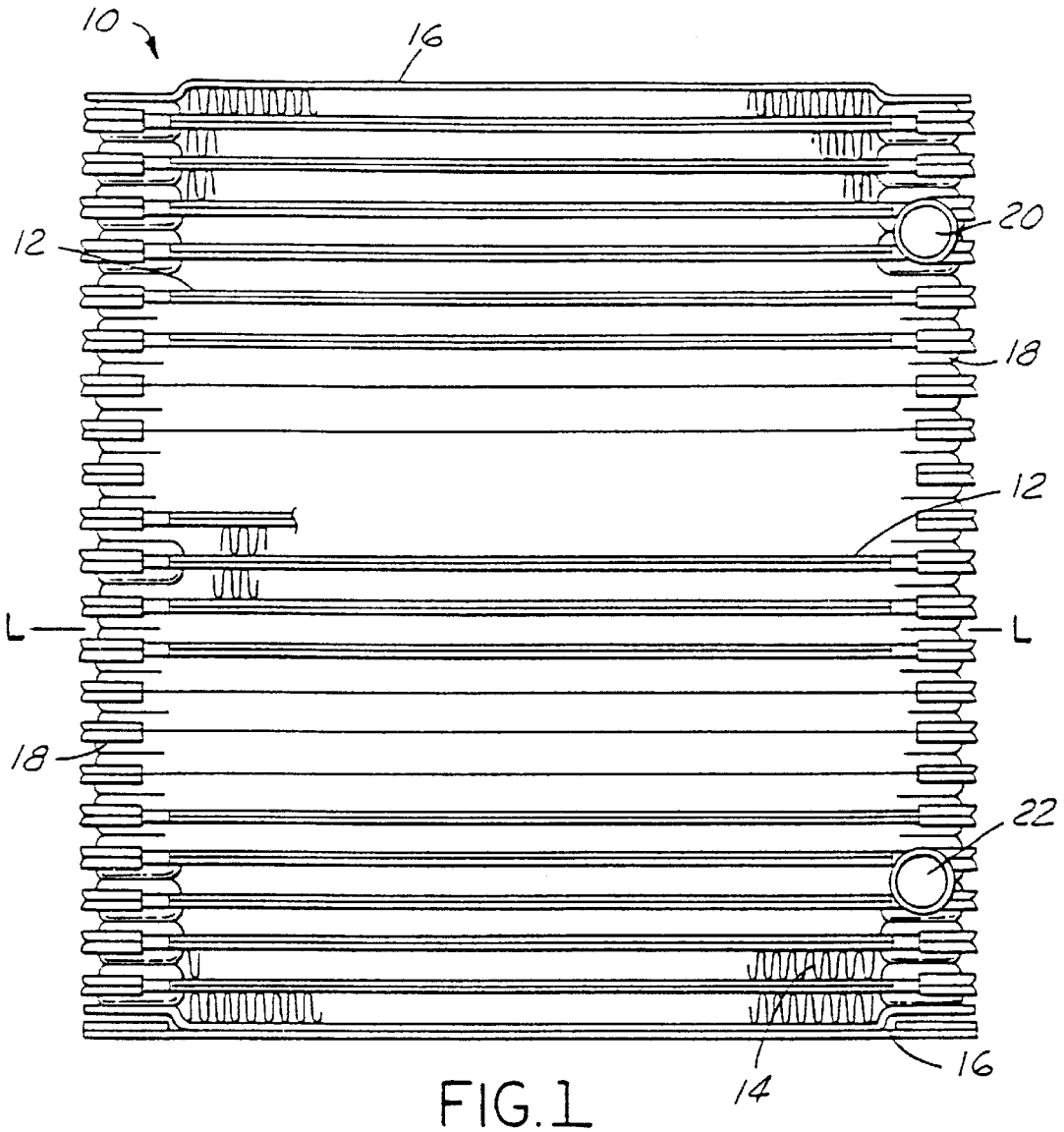
FIG. 1 is a front view of a heat exchanger structured in accord with the principles of the present invention.

Referring now to the drawings, FIG. 1 shows a plate-tube heat exchanger, generally designated by the numeral 10, in the form of an evaporator particularly adapted for use in an automobile air conditioning system. The heat exchanger 10 comprises a stack of formed, elongated plates 12, pairs of which are joined together in face-to-face relationship so that adjacent pairs provide alternate passageways for the flow of refrigerant therebetween as will be described further below. The plates may be joined in any of a variety of known processes, such as through brazing or a lamination process. Heat transfer fins 14 are positioned between joined pairs of plates 12 to provide increased heat transfer area as is well known in the art. The joined plate pairs and fin assemblies are contained within endsheets 16.

The heat exchanger 10 includes an inlet port 20 and an outlet port 22 formed within a header 18 at either one or both ends of the heat exchanger 10. The header is in direct communication with the passageways between the joined pairs of plates 12 as will become apparent from the following description. The plates 12 have aligned apertures at the ends thereof providing communication between inlet and outlet ports 20, 22, respectively, of header 18. However, as is well known in the art, each of the plates can include apertures at either one or both ends thereof and the inlet and outlet ports 20, 22 can be located at opposite ends of the heat exchanger as is well known in the art. In the heat exchanger FIG. 1, refrigerant is directed into the inlet port 20, passed through the pair plurality of joined plates 12 in a known manner. The refrigerant then exits through outlet ports 22 to complete the cooling cycle.

Figure 2:
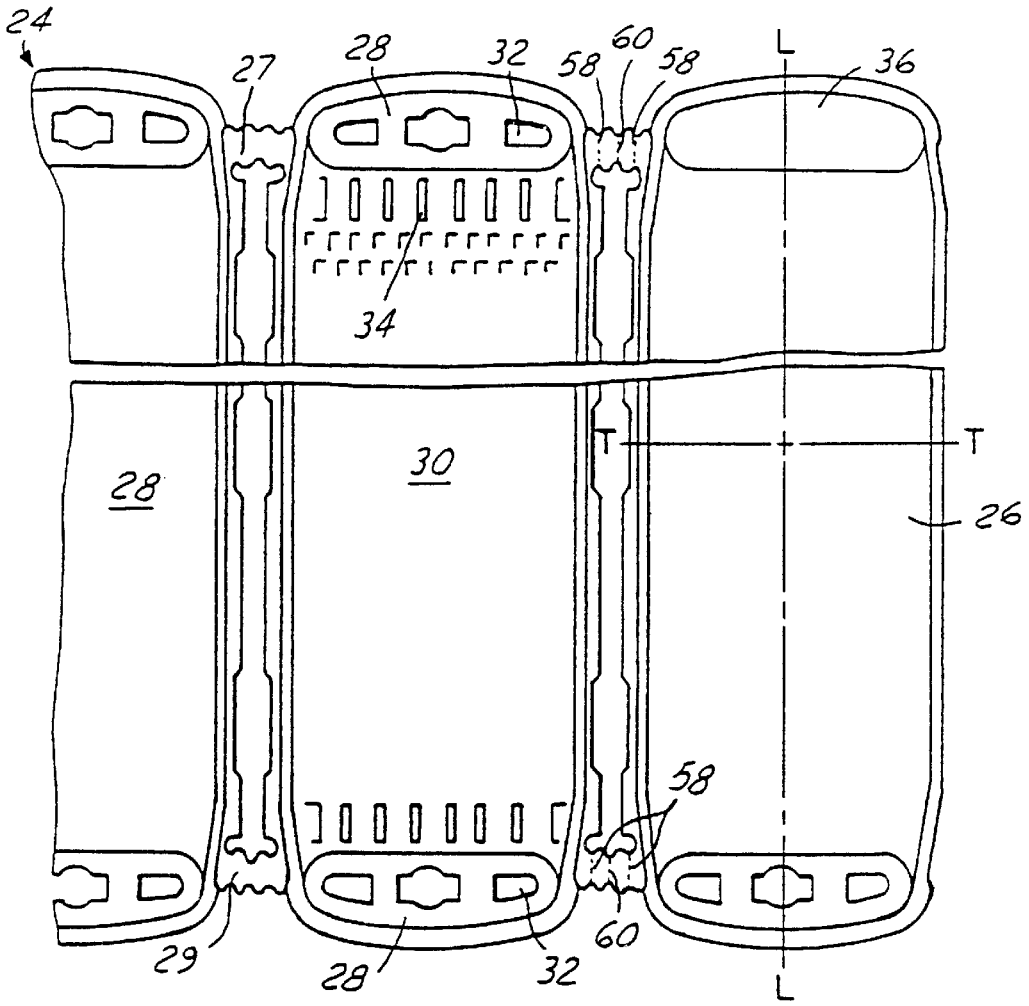
FIG. 2 is a to plan view showing a portion of a strip of preformed plates.

As shown in FIG. 2, the plate members 26 are formed from a single sheet of material 24 and are interconnected by a first set of deformable links 27 and a second set of deformable links 29 which will be described in greater detail below. Each of the plates 24 is generally planar and include a longitudinal axis denoted by line L—L and a transverse axis denoted by line T—T. The longitudinal axis of the plates (L—L) is parallel to the longitudinal axis of the heat exchanger core. Stated another way, the longitudinal axis of the heat exchanger core is perpendicular to the general direction of air flow passing through the core. The material 24 can be an aluminum material coated with an aluminum brazing alloy as is known in the art. A sheet of material 24 can either be of a predetermined length with a predetermined number of plate members 26 therein or may be formed as a continuous strip of material which is cut at a predetermined number of plates to form a heat exchanger of predetermined size. The plate members 26 are stamped using pneumatic and/or hydraulic activated details in a die controlled by a PLC\PLS or other computerized means known in the die pressing art.

Each of the plate members 26 includes a pair of end portions 28 and an intermediate portion 30 therebetween. A plurality of apertures 32 can be formed in each of the end portions 28 or alternatively, a single aperture can be formed therein. The apertures are aligned when the heat exchanger is assembled to provide for a fluid conduit for the heat exchanger fluid to pass therethrough. As shown in FIG. 2, the central aperture includes a radius portion. The radius portion provides for alignment of the inlet tube during its insertion into the core during the assembly process. Each of the intermediate portions 30 of the plate members 26 includes a plurality of beads 34 which, as is well known in the art, provide a circuitous path for the fluid to pass through the plate tube 12 to increase the turbulence of the fluid and provide for better heat transfer characteristics.

As further shown in FIG. 2, selected end portions 28 of plate members 26 include end portions in which the apertures 32 are not included. These blanked ends 36 provide a baffle means in the heat exchanger by not allowing the fluid to pass thereby, forcing the fluid to assume a new flow direction within the heat exchanger. This provides an advantage over known heat exchangers without the baffle means which may not work as effectively as the present invention. At the time the plate members 26 are formed, it is determined which of the selected end portions of the plate members are blanked (at 36) to form the baffle means of the heat exchanger. The manifold plates are then also formed.

As shown in FIG. 2, the deformable links 27 and 29 are indented at predetermined locations to form a series of preferential bend zones indicated by dashed lines 58, 60. The bend zone indicated by dashed line 60 is the preferred bending zone when adjacent pairs of mating plates are to be folded face-to-face. The bend zones indicated by dashed lines 58 are the preferred locations at which the links 27, 29 are to be bent between pairs of mating plates. The distance between the bend zones 58 is preferably the same distance as the thickness of the fin members 14 to be inserted between the pairs of mating plates.

Figure 3:
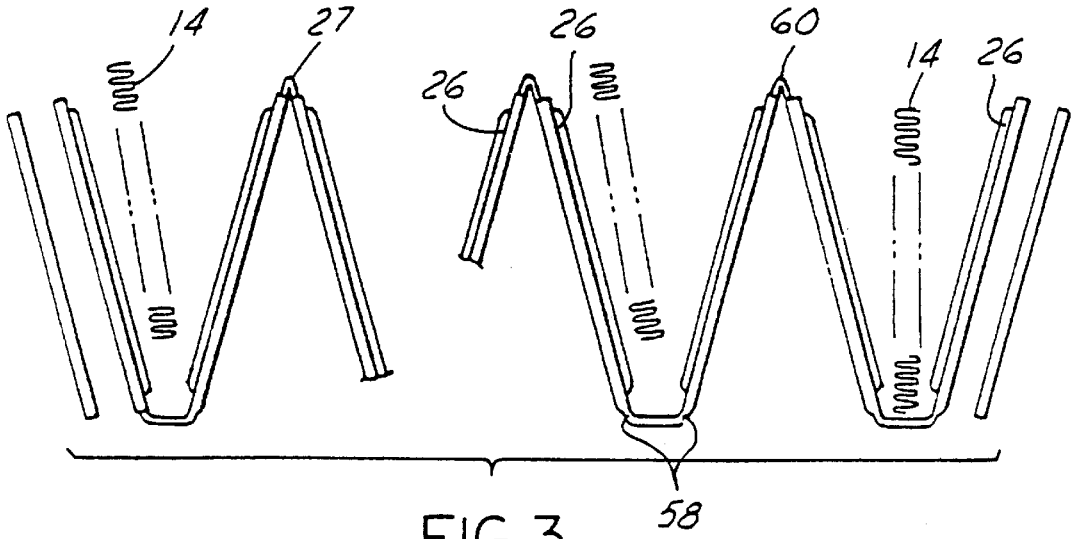
FIG. 3 is a side view showing a portion of a strip of preformed plates being folded into a core.
Figure 4:
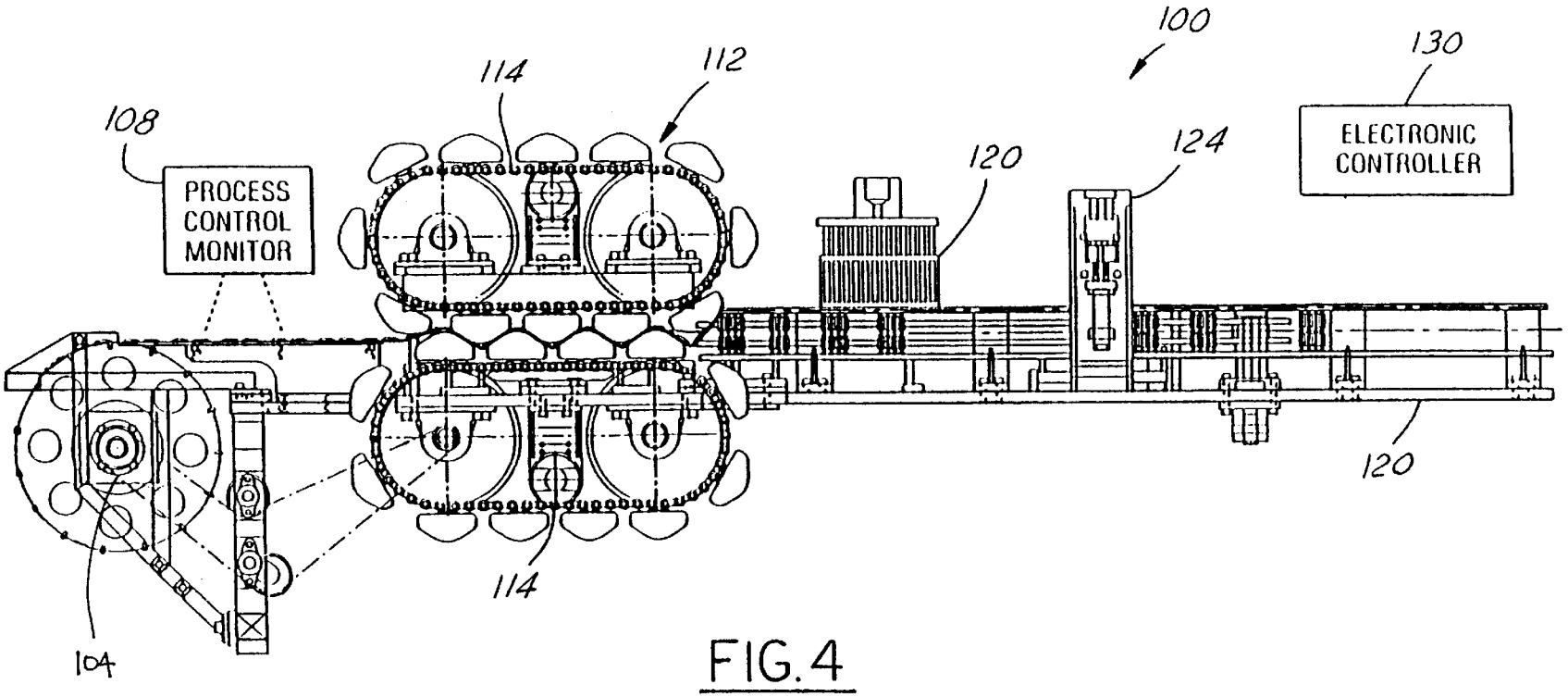
FIG. 4 is a side view of a machine for folding the strip of plates into a core.
Figure 5:
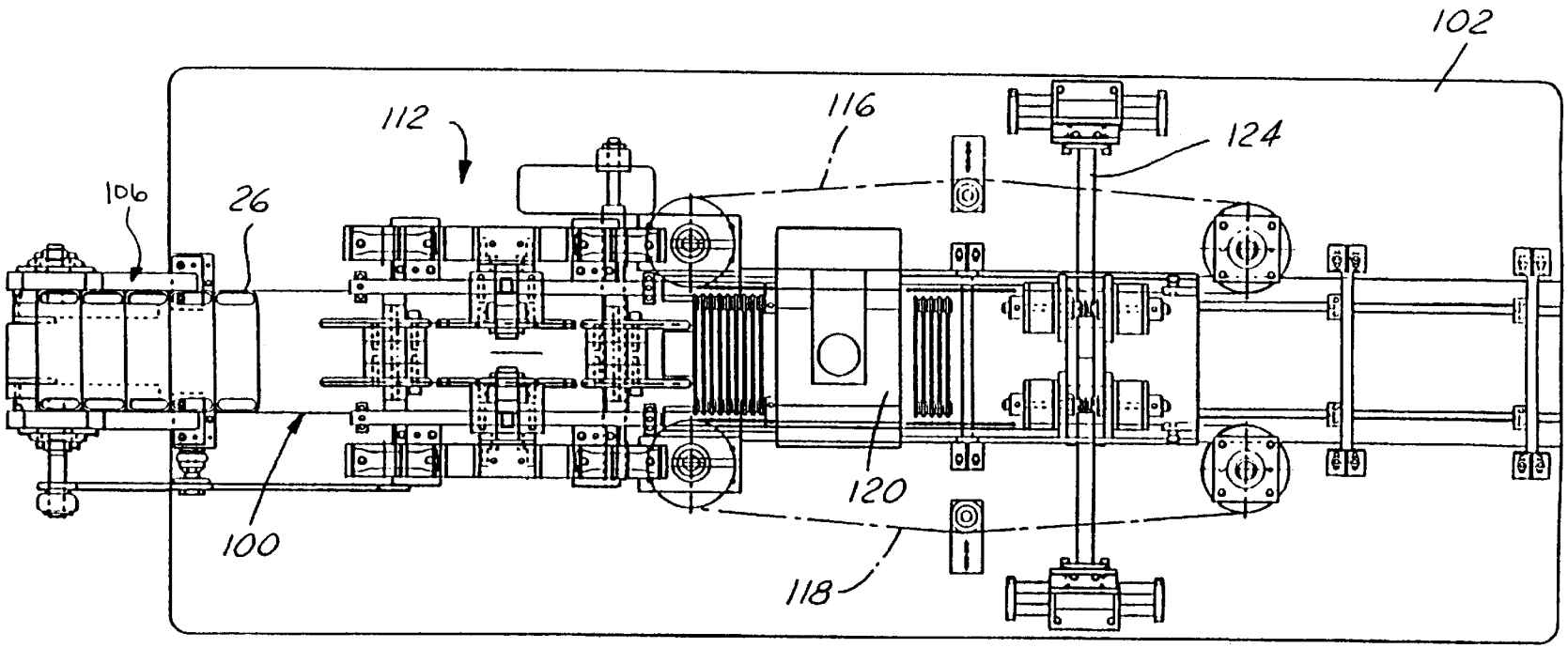
FIG. 5 is a top plan view of the machine of FIG. 4.

The formation of the core element of the heat exchanger 10 can be accomplished by a corrugation machine. An example of one such machine which can be used to form a heat exchanger core is shown in FIGS. 4 and 5. Referring back to FIG. 3, the deformable links 27, 29 of the continuous strip of alternating plates are initially folded in a folding area by a fold forming machine to impart to the continuous strip an initial corrugation. The initial corrugated strip is then gathered in a gathering area by a gathering mechanism in which the folding of the deformable links is substantially completed and which results in a first set of folded deformable links and a second set of deformable links. The difference between the first and second set of deformable links results from the different bending zones, 58 and 60, located in each link. These differences will be described in greater detail below. Fin members 14 are then inserted between adjacent plate tubes by a fin stuffing machine.

To form a heat exchanger core with a predetermined number of plate tubes, one set of each of the first and second set of deformable links is cut off after a desired number of plate tubes has been completed. FIGS. 4 and 5 illustrate one example of a corrugation machine for fabricating such a heat exchanger core. The corrugation machine 100 has a base 102 including a feed mechanism 104 provided at one end for feeding the strip containing preformed plates to a material guide 106 which longitudinally aligns the strip in the machine, a fold forming mechanism 112, a gathering mechanism 116, a fin stuffing mechanism 120 and a link cut-off device 124.

The corrugation machine 100 includes a process control monitor 108 and a fold forming mechanism 112. The process control monitor may be an optical or mechanical device adapted to detect predetermined plates such as the end plates of a core element and to count the number of plates between the predetermined plates to assure that each core severed from the continues strip of preformed plates will have the proper number of plates. The fold forming mechanism 112 consists of two pairs of opposing tractor or caterpillar drives 114 disposed on opposite sides of plates 12. The drives include lugs which engage the plates 12 such that as the drives rotate, the plates are caused to begin folding at the deformable links 27, 29.

The gathering of the folded plates after they exit the fold forming mechanism 112 is accomplished by a pair of gathering belts 116, 118 (FIG. 5). Each of these belts has an upper and lower belt including lugs for engaging the plates and controlling the folding between mated pairs of plates as well as between individual plates. After leaving the gathering mechanism, corrugated fins are inserted between mated pairs of plates. This is accomplished by a fin stuffing machine 120 which collects a predetermined number of fins corresponding to the number of spaces between mated pairs of plates. The fins are then dropped or pushed by the stuffing machine 120 into appropriate spaces between mated pairs of plates. An electronic controller 130 controls the number of fins aligned in the stuffing machine and the placing of the fins into the heat exchanger core. After the fins are stuffed into the core, the gathering belts are restarted to transport a new batch of folded plates under the fin stuffing machine.

After a predetermined number of mated plate pairs have been stuffed with fins and folded, a link is cut to separate this formed core from the next adjacent core. The folded links are cut at both ends of the heat exchanger core, but only those links between adjacent cores are cut.

Figure 6:
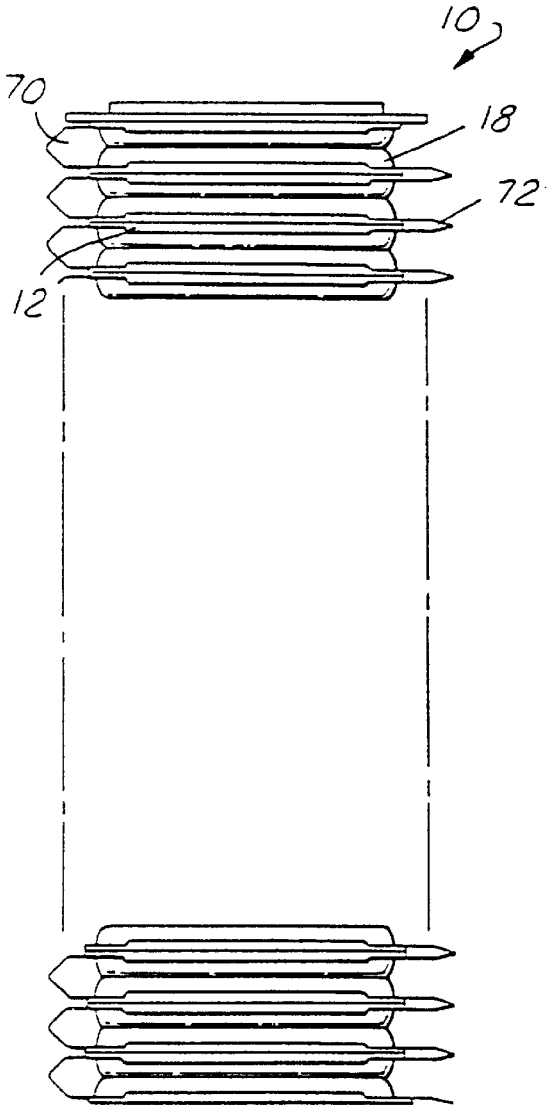
FIG. 6 is a top plan view of a heat exchanger structured in accord with the principles of the present invention prior to the links being folded.

FIG. 6 shows a top plan view of one end of the heat exchanger core 10 after the core has been through the link cut-off machine. As shown, the core includes a plurality of folded links projecting outwardly from the core. These links include a first set of links 70 and a second set of links 72. The first set of folded links 70 is formed at bend zones 58 and separate adjacent, mated pairs of plates to define the open space into which the fin members 14 are placed. The first set of folded links 70 are more open than the second set of folded links 72. The second set of folded links 72 are formed at bend zones 60 which act to mate two adjacent plate members to one another to form a plate tube. Because the mated plates must be physically connected to an adjacent plate, the second set of folded links 72 are somewhat more narrow than the first set of links 70.

If these projecting folded links 70, 72 were left as is, they would interfere with packaging, such as a heat exchanger case, when inserted into such. Also, during transport of the cores 10 to a brazing furnace or for use in assembly, the cores 10 are often stacked one upon another. These projecting folded links interfere and get tangled with adjacent, stacked cores, often resulting in punctured or damaged heat exchanger cores. To overcome this problem, the projecting links are folded against the heat exchanger core such as is shown in FIG. 7.

Figure 7:
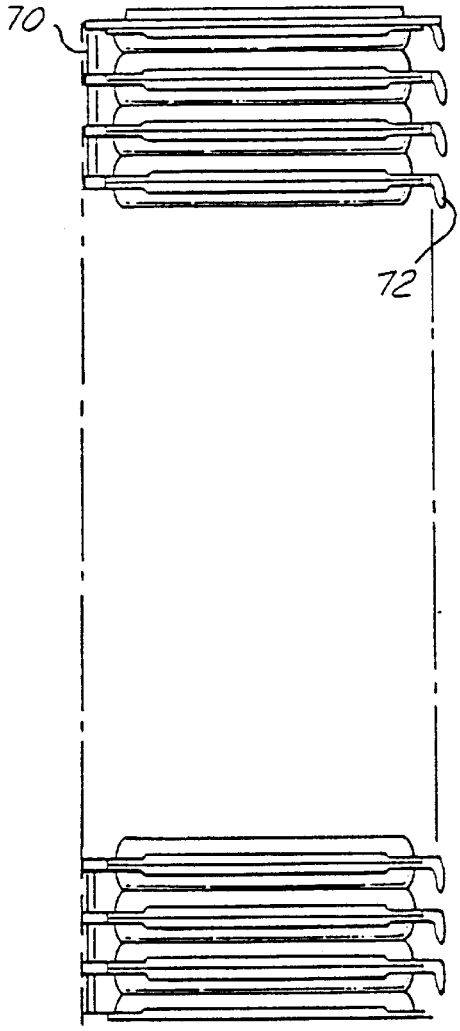
FIG. 7 is a top plan view of a heat exchanger structured in accord with the principles of the present invention after the links have been folded.

FIG. 7 shows that both of the first 70 and second 72 sets of folded links are folded against the heat exchanger core and do not extend or project outwardly as far from the core as before. Each plate member 12 is a generally planar, elongate member having a longitudinal and traverse axes. Fluid flow through mated plate pairs (plate tubes) typically is parallel to the longitudinal axis of the plates. Keeping this orientation, the first set of folded links 70 are folded against the core in a direction generally parallel to the longitudinal axis of the plate members. The second set of folded links 72 are folded in a direction different than the first set of links 70, although they could be folded the same. In the preferred embodiment, the second set of links 72 are folded in a direction generally perpendicular to the longitudinal axis of the plates 12, in a direction generally parallel to the transverse direction of the plates 12.

Figure 8:
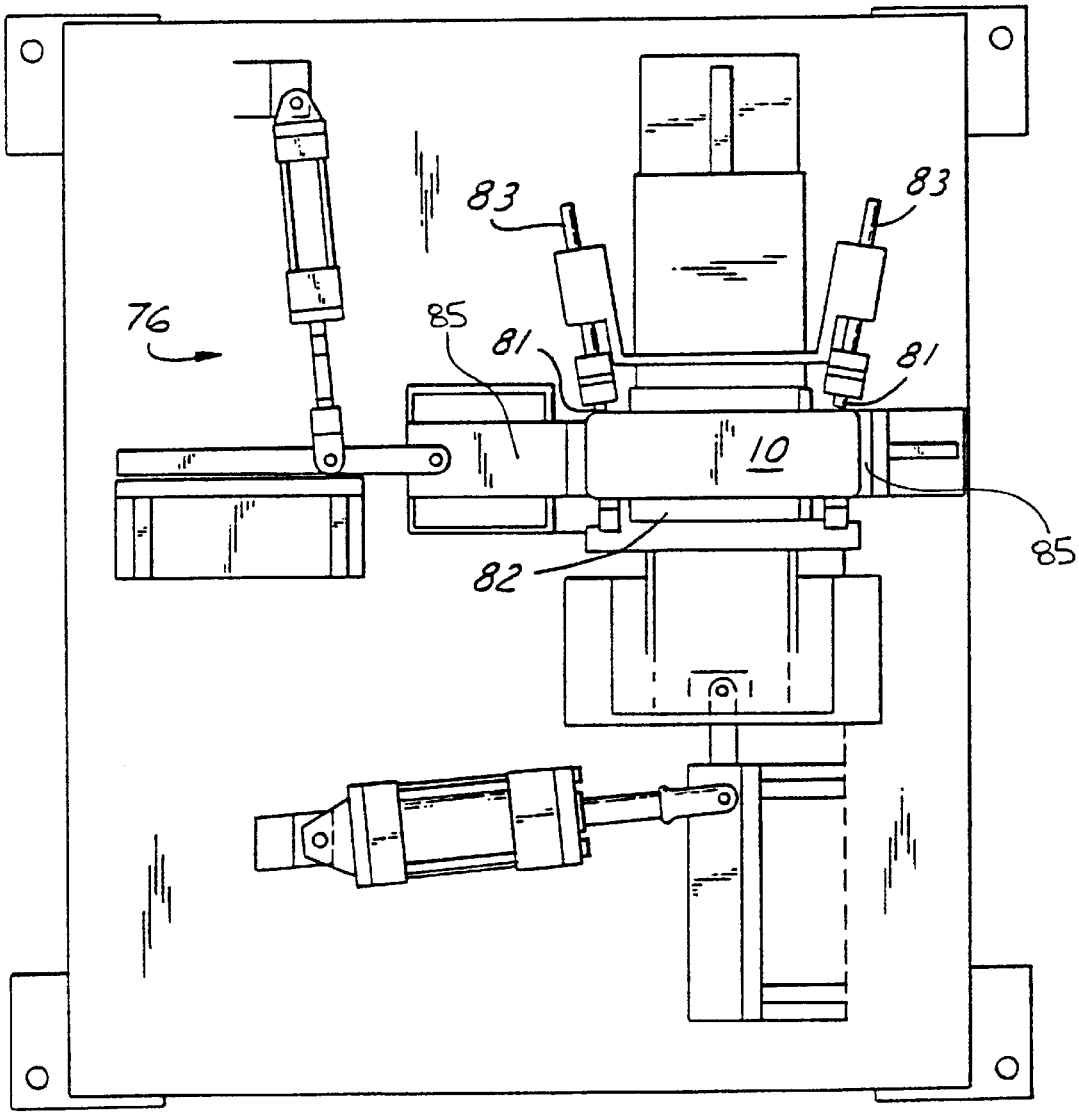
FIG. 8 is a top plan view of a machine for bending the folded links in accord with the present invention.
Figure 9:
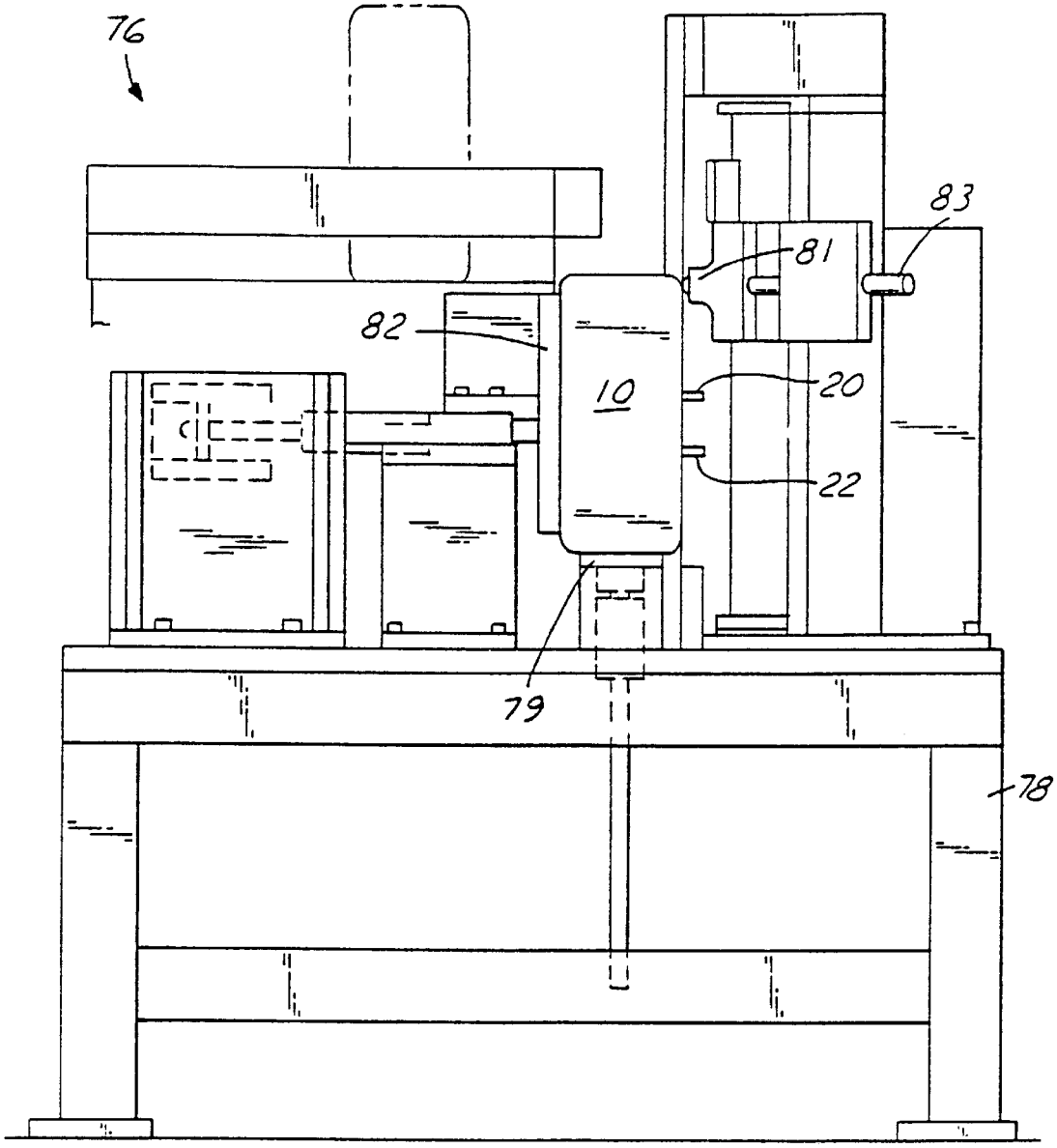
FIG. 9 is a side view of the machine of FIG. 8.

FIGS. 8–10 show a machine for bending the folded links according to the present invention. The machine 76 can be an integrated part of the corrugation machine described in FIGS. 4 and 5, or may be a stand alone machine. After the heat exchanger cores 10 leave the link cut-off machine 124 and before they are sent to a brazing furnace, the cores are transported to the link bending machine 76. The machine 76 has a base 78 and a transport mechanism 79 for transporting the cores 10 to the work station 80 in the machine. After the cores 10 are transported to the machine 76, the cores are locked into a predetermined orientation by reciprocatory hydraulic or pneumatic rams 85, one which exposes the first set of folded links 70 outwardly from the machine 76. A reciprocating die or punch 82, activated hydraulically or pneumatically, engages the entire first set of folded links 70 and applies a force against the first set of links 70 in a direction generally perpendicularly to the plane of the plate members. This causes all the links in the first set 70 to bend instantaneously in a direction generally parallel to the longitudinal axis of the plate member 12.

Figure 10A:
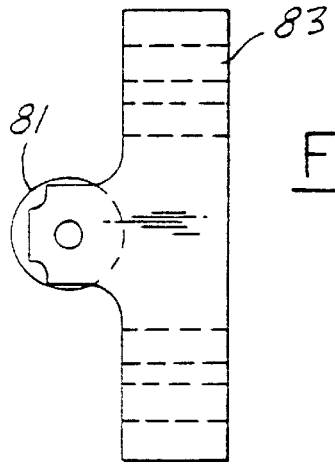
FIGS. 10A and B are enlarged views of a portion of the machine of FIG. 8.
Figure 10B:
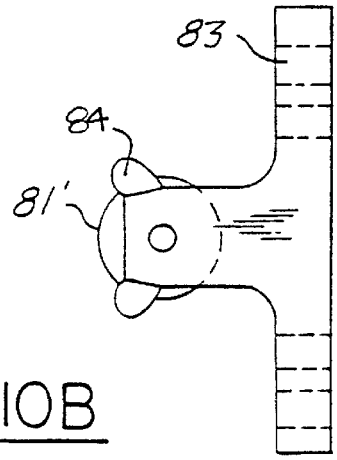

Next, a pair of rollers 81 are urged against the second set of folded links 72. In contrast to the punch which bends all the links 70 in the first set simultaneously, the pair of rollers 81 fold each of the links in the second set serially, or one after another. The rollers 81 apply a force against the links 72 in a direction generally perpendicular to the plane of the plates 12 and bend the links 72 in a direction generally parallel to the transverse axis (T—T) of the plate 12. As shown in FIG. 10A, the rollers 81 rotates at the end of a rigid arm 83 which can be hydraulically or pneumatically controlled. The arms 83 move fore and aft to contact the links 72 and reciprocate in a vertical, up-and-down direction to bend each of the links 72 serially. In another embodiment of the invention, the rollers 81' can selectively engage and disengage the second set of links 72. In some embodiments, the heat exchanger core 10 includes fluid manifolds (inlet and outlet) which project from the middle of the fluid tanks as opposed from the ends. With this design, the fluid manifolds are spaced between and project through the second set of folded links 72. The rollers 81' must be able to navigate around these manifolds to bend the links 72 without causing damage to the manifolds. FIG. 10B shows a design of a roller 81' which can accomplish this. The rollers 81' includes a flexible member 84 which contains a sensor. The sensor, either optical or mechanical, determines the presence of the manifold or other obstruction and sends a signal to a controller which raises the rigid arms away from the core. After the obstruction has passed, the controller causes the arms and rollers to engage the links once again. Alternatively, the rollers 81' can be preprogrammed so that the controller automatically raises and lowers the rigid arms to avoid the manifold or other obstructions.

After the links have been folded, the core is then placed into a brazing furnace and passed through a brazing operation in which the metal brazes together in order to form the completed article.

Various modifications and alterations of the present invention will, no doubt, occur to those skilled in the art to which this invention pertains. These and all other variations which rely upon the teachings by which this disclosure has advanced the art are properly considered within the scope of this invention as defined by the appended claims.

What is claimed is:

1. A machine for bending a first set and a second set of folded deformable links projecting outwardly from a heat exchanger core made from a continuous strip of preformed, generally planar plates interconnected together in a bellows-like manner by said first and second set of folded deformable links, comprising:

a base;

a transport mechanism for transporting said core to a workstation;

a locking mechanism for locking said core in a predetermined orientation in said workstation; and a bending mechanism attached to said base and including a first bending mechanism for bending said first set of folded deformable links against said core which includes a reciprocating die operative to simultaneously apply a force against the entire first set of deformable links in a direction generally perpendicular to the plane of said plates and a second bending mechanism for bending the second set of folded deformable links which includes a rolling mechanism for applying a force against said second set of deformable links in a direction generally parallel to the plane of said plates for serially deforming said deformable links of said second set of deformable links.

2. A machine according to claim 1, wherein said rolling mechanism is configured to engage and disengage said deformable links in a controlled manner.

3. A machine according to claim 2, wherein said controlled manner includes disengaging said deformable links when an obstruction is present.

* * * * *